United States Patent [19]

Tucker

[11] Patent Number: 5,074,565

[45] Date of Patent: Dec. 24, 1991

[54] GOLF PUTTING TRAINING DEVICE

[76] Inventor: Terence Tucker, 29 Gavina, Monarch Beach, Calif. 92677

[21] Appl. No.: 665,805

[22] Filed: Mar. 6, 1991

[51] Int. Cl.[5] ..... A63B 69/36

[52] U.S. Cl. ..... 273/192

[58] Field of Search ..... 273/192, 191 R, 191 A, 273/191 B, 186 R

[56] References Cited

U.S. PATENT DOCUMENTS

| | | | |
|---|---|---|---|
| 2,084,901 | 6/1937 | Eisenberg | 273/192 |
| 2,303,736 | 12/1942 | Hall | 273/192 X |
| 2,723,858 | 11/1955 | Chizewski | 273/192 |
| 3,132,865 | 5/1964 | Parker | 273/192 |
| 3,471,155 | 10/1969 | Donaldson | 273/186 R |
| 3,473,810 | 10/1969 | Nishikawa | 273/192 |
| 3,685,835 | 8/1972 | Fahy | 273/192 |
| 4,133,535 | 1/1979 | Marsh | 273/192 |
| 4,334,684 | 6/1982 | Sterling | 273/192 X |
| 4,634,131 | 1/1987 | Vella et al. | 273/192 |
| 4,700,949 | 10/1987 | Nottoli | 273/192 |

*Primary Examiner*—George J. Marlo
*Attorney, Agent, or Firm*—Stetina and Brunda

[57] ABSTRACT

This invention relates to a golf putting training device adapted to allow a user to develop a putting stroke which is more natural, comfortable, and automatic. The device generally comprises a pair of rod members rigidly mounted to and extending between a pair of end brackets in a vertical plane. A carriage is slidably mounted to the rod members in a manner wherein the carriage may travel in a horizontal direction between the end brackets. Extending from the carriage is an elongate shaft member which includes an openable and closable mounting means for releasably mounting a golf putter to the shaft member. When closed about the shaft portion of the golf putter, the mounting means is adapted to allow the shaft portion of the golf putter to slide axially relative to the mounting means and also is adapted to permit rotational movement of the shaft portion via a ball and socket joint about a generally horizontal axis in a manner wherein the putter may be angularly adjusted relative to the rod members.

4 Claims, 4 Drawing Sheets

Fig. 11
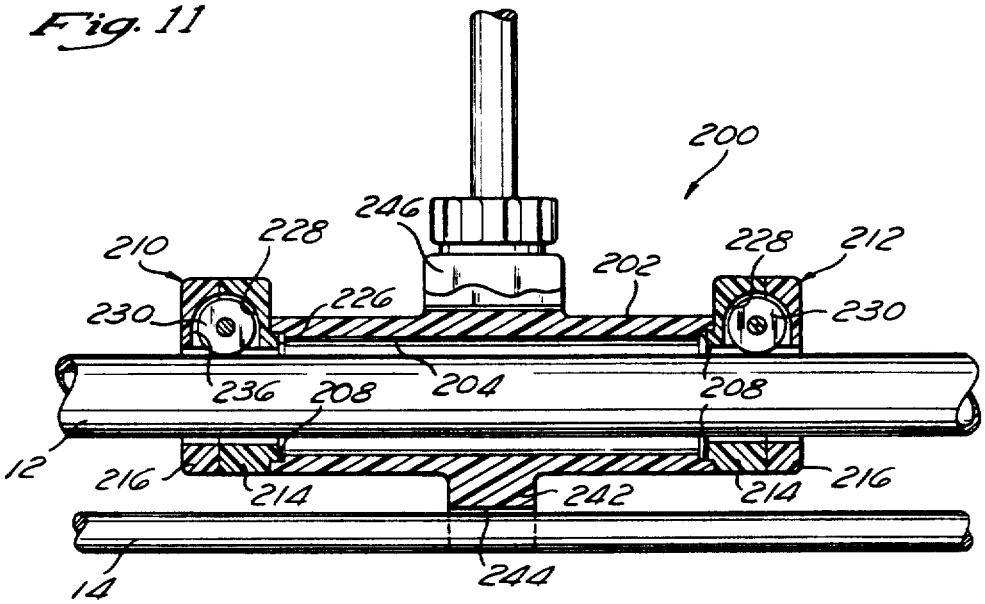
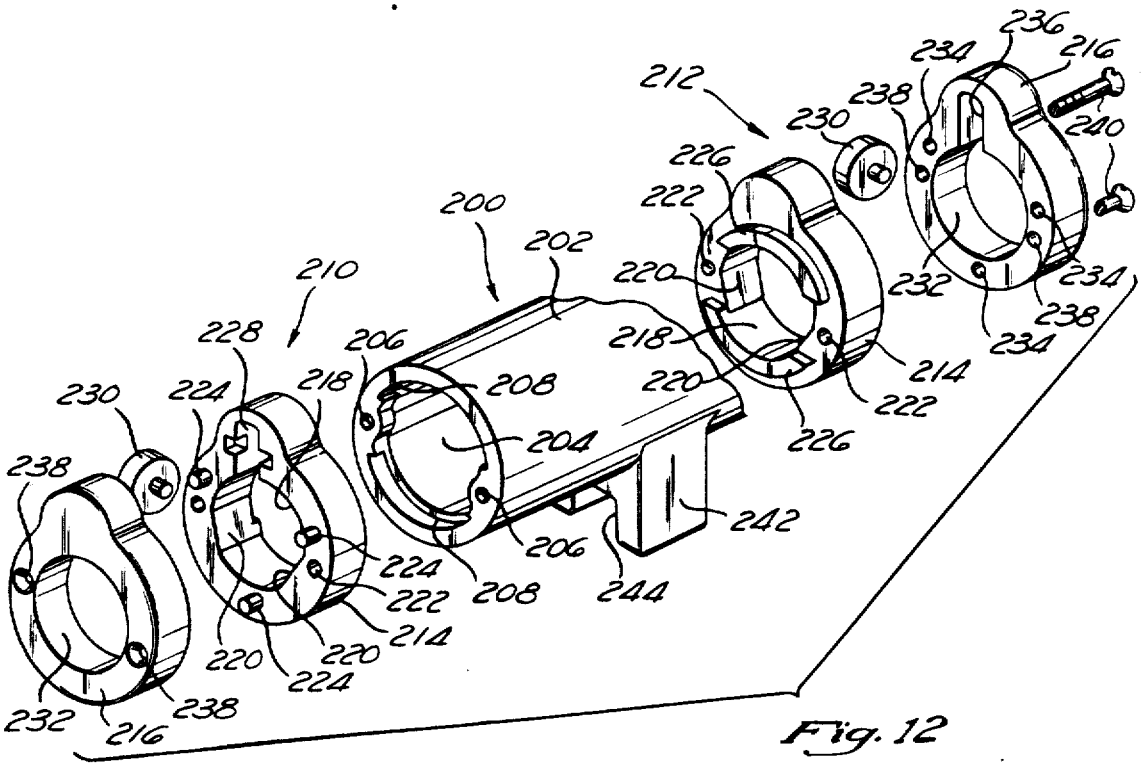
Fig. 12

GOLF PUTTING TRAINING DEVICE

FIELD OF THE INVENTION

The present invention relates generally to sports equipment, and more particularly to a golf putting training device adapted to allow a user to develop a proper putting stroke which is more natural, comfortable, and automatic.

BACKGROUND OF THE INVENTION

One of the most difficult skills to acquire in playing the game of golf is that of an accurate putting stroke. This difficulty is largely due to the necessity in putting for striking the golf ball with the head of the putter at an orientation precisely perpendicular to the intended path of the ball. The difficulty is further enhanced by the need to maintain the aforementioned putter orientation during the entire putting stroke.

Because of the large number of golfers and the desire of many of those golfers to develop a proper putting technique, many golf putting training devices are currently known in the prior art. These devices however possess certain inherent deficiencies which detract from their overall utility. Foremost of these deficiencies is the inability of the prior art devices to allow the shaft portion of the putter to move axially relative to the particular structure used to mount the putter to the training device. As will be appreciated by those familiar with basic putting techniques, this particular deficiency inhibits the ability of the training device user to maintain his/her natural putting stroke. The present invention overcomes these and other deficiencies associated with the prior art.

SUMMARY OF THE INVENTION

In accordance with a preferred embodiment of the present invention there is provided a golf putting training device to aid a user in developing a proper putting stroke. The training device generally comprises a pair of rod members which are rigidly mounted to and extend between a pair of end brackets. The rod members are in substantial parallel relation and in generally vertical alignment, with the upper rod member having a diameter exceeding the diameter of the lower rod member. A carriage is slidably mounted to the rod members in a manner wherein the carriage may travel in a horizontal direction between the end brackets. A pair of support legs are attached to the end brackets in a manner wherein the support legs are articulable between an operative position and a stowed position. When in the operative position, the support legs extend generally perpendicularly relative to the rod members, while in the stowed position the support legs are disposed in an orientation generally parallel to the rod members. In the preferred embodiment, each of the support legs includes a connector attached thereto which is adapted to secure the respective support leg to the lower rod member when the support leg is in the stowed position.

Extending angularly upwardly from the top surface of the carriage is an elongate shaft member. Connected to the outer end of the shaft member is a means for releasably mounting a shaft portion of a golf putter to the shaft member. The mounting means preferably includes a latch mechanism which is movable between an open position and a closed position. When in the open position, the latch mechanism is adapted to receive the shaft portion of the golf putter. When in the closed position, the latch mechanism is adapted to secure the shaft portion of the golf putter to the shaft member in a manner wherein the shaft portion may slide axially in a generally vertical orientation relative to the latch mechanism. The mounting means is further adapted to permit rotational movement of the shaft portion of the golf putter such that the putter may be angularly adjusted relative to only a generally horizontal axis. In this respect, the mounting means preferably includes a ball and socket joint adapted to be pivotal about a single axis.

It is an object of the present invention to provide a golf putting training device wherein the golf putter may slide axially in a generally vertical orientation relative to the structure used to mount the putter to the training device.

Another object of the present invention is to provide a golf putting training device wherein the putter may be angularly adjusted relative to the device.

Another object of the present invention is to provide a golf putting training device which is collapsible and easily stored within a golf bag.

BRIEF DESCRIPTION OF THE DRAWINGS

These as well as other features of the present invention will become apparent upon reference to the drawings wherein:

FIG. 11 is a cross-sectional view illustrating the manner in which a carriage constructed in accordance with a second embodiment is interfaced to the rod members; and FIG. 12 is an exploded view illustrating the components comprising the carriage of the second embodiment.

DETAILED DESCRIPTION OF THE PREFERRED EMBODIMENT

Figure 1:
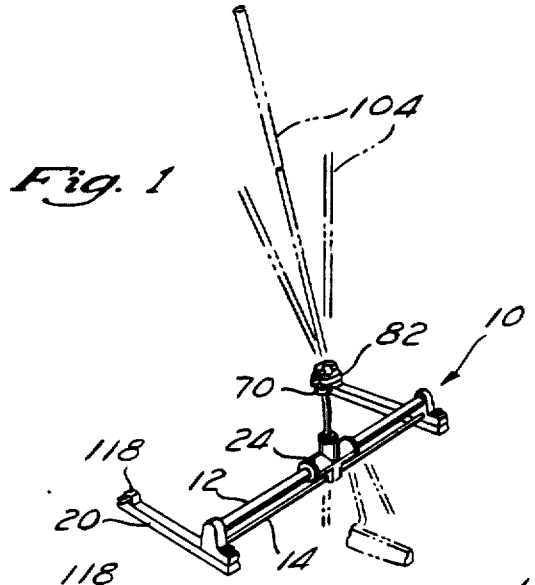
FIG. 1 is a perspective view of the training device of the present invention, illustrating a golf putter (shown in phantom) mounted thereto.
Figure 2:
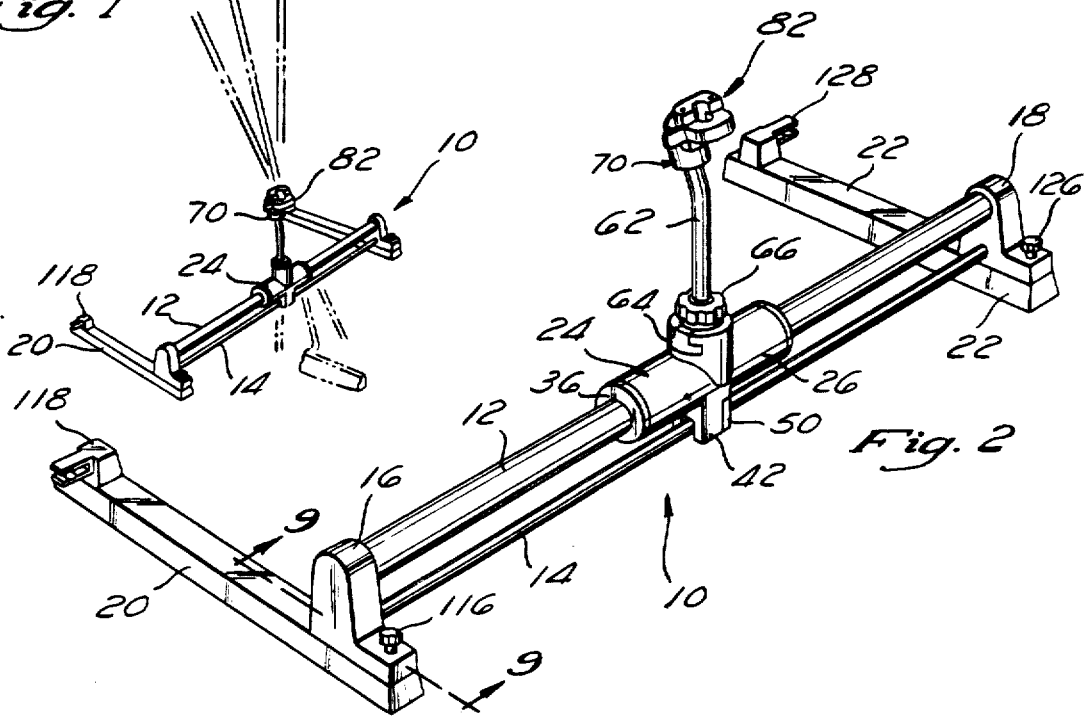
FIGS. 2 and 3 are perspective views of the training device of the present invention.
Figure 3:
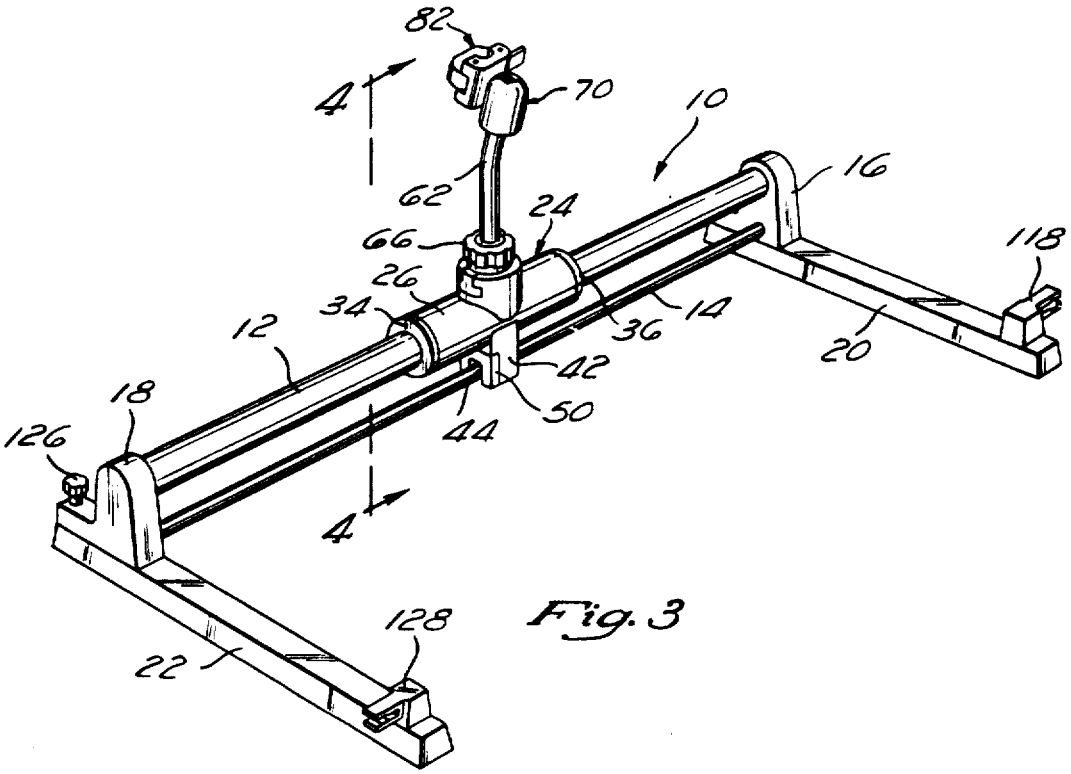

Referring now to the drawings wherein the showings are for purposes of illustrating a preferred embodiment of the present invention only and not for purposes of limiting the same, FIGS. 1-3 are perspective views illustrating the golf putting training device 10 constructed in accordance with the preferred embodiment of the present invention. Training device 10 generally comprises an upper rod member 12 and a lower rod member 14 which are rigidly mounted to and extend between a first end bracket 16 and a second end bracket 18. Attached to first end bracket 16 is a first support leg 20 while attached to second end bracket 18 is a second support leg 22. The use and operation of support legs 20, 22 will be explained in greater detail below.

Figure 4:
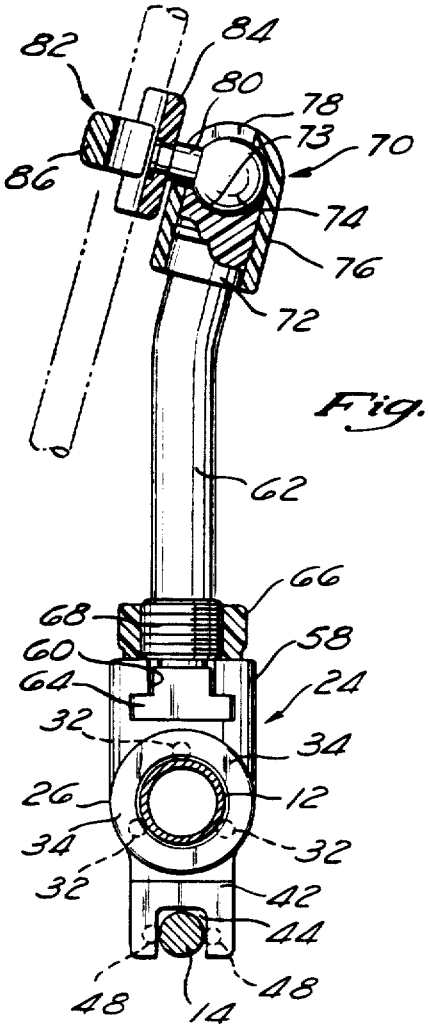
FIG. 4 is a cross-sectional view taken along line 4—4 of FIG 3.
Figure 5:
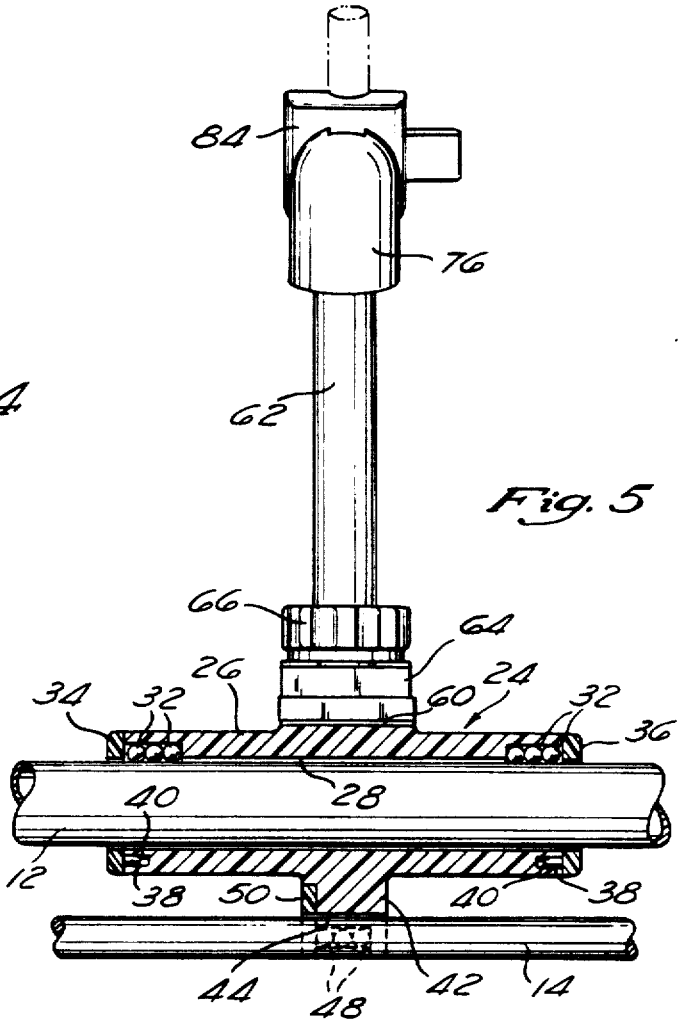
FIG. 5 is a cross-sectional view illustrating the manner in which the carriage is interfaced to the rod members.
Figure 6:
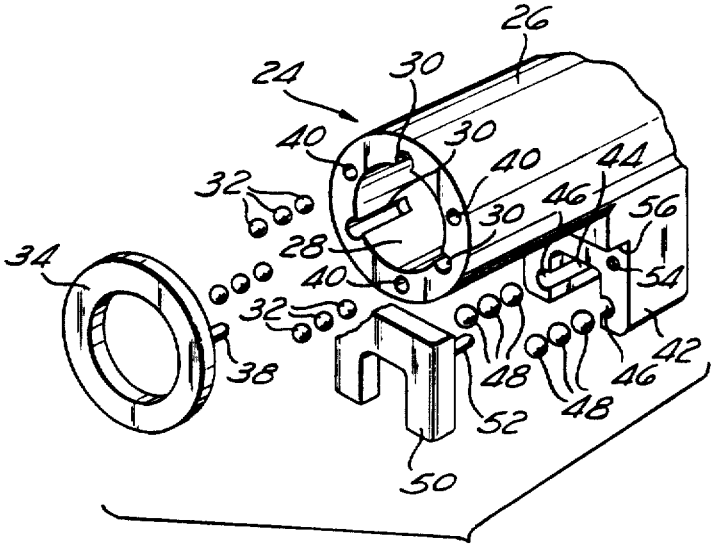
FIG. 6 is an exploded view illustrating the components comprising the carriage.

A carriage 24 is slidably mounted to upper rod 12 and lower rod 14 in a manner wherein carriage 24 may travel in a horizontal direction between first end bracket 16 and second end bracket 18. Referring now to FIGS. 4–6, carriage 24 generally comprises an elongate sleeve 26 having a bore 28 extending axially therethrough which is sized and configured to slidably receive upper rod member 12. Disposed within sleeve 26 adjacent the opposed ends thereof are ball-bearing receiving slots 30 each of which are adapted to receive a plurality of ball-bearings 32. Ball-bearing receiving slots 30 are sized and configured such that at least a portion of ball-bearings 32 will be in face-to-face contact with upper rod member 12 when upper rod member 12 is disposed within bore 28. As can be appreciated, the contact between ball-bearings 32 and upper rod member 12 facilitates the slidable movement of carriage 24 along upper rod member 12. Ball-bearings 32 are maintained within receiving slots 30 by a first sleeve cap 34 and second sleeve cap 36, each of which are attached to an end of sleeve 26. First sleeve cap 34 and second sleeve cap 36 each include projections 38 extending outwardly from one side thereof. Projections 38 are each sized and configured to be receivable into apertures 40 disposed within the opposed ends of sleeve 26. As can be appreciated, the receipt of projections 38 of first sleeve cap 34 and second sleeve cap 36 into apertures 40 facilitates the attachment of first sleeve cap 34 and second sleeve cap 36 to sleeve 26. Extending downwardly from sleeve 26 is a column 42 which defines a generally U-shaped recess 44 therein. U-shaped recess 44 is sized and configured to receive lower rod member 14. Similar to receiving slots 30 as previously described with respect to sleeve 26, column 42 includes ball-bearing receiving slots 46 disposed therein which are sized and configured to receive ball-bearings 48. As with receiving slots 30, receiving slots 46 are sized and configured such that at least a portion of ball-bearings 48 will be in face-to-face contact with lower rod member 14 when lower rod member 14 is disposed within U-shaped recess 44. Ball-bearings 48 are maintained within receiving slots 46 by a column cap 50. Column cap 50 includes extensions 52 extending outwardly from one side thereof which are sized and configured to be receivable into column apertures 54 disposed within column 42. Additionally, as best seen in FIG. 6, column 42 further defines a notch 56 therein which is sized and configured to receive column cap 50 in a manner such that column cap 50 does not protrude outwardly from column 42. It will be appreciated that the receipt of lower rod member 14 into U-shaped recess 44 is adapted to prevent sleeve 26 from rotating about upper rod member 12. Sleeve 26 further includes a boss 58 extending upwardly therefrom. Boss 58 defines a generally T-shaped notch 60 formed therein, the use of which will be explained in greater detail below.

Figure 7:
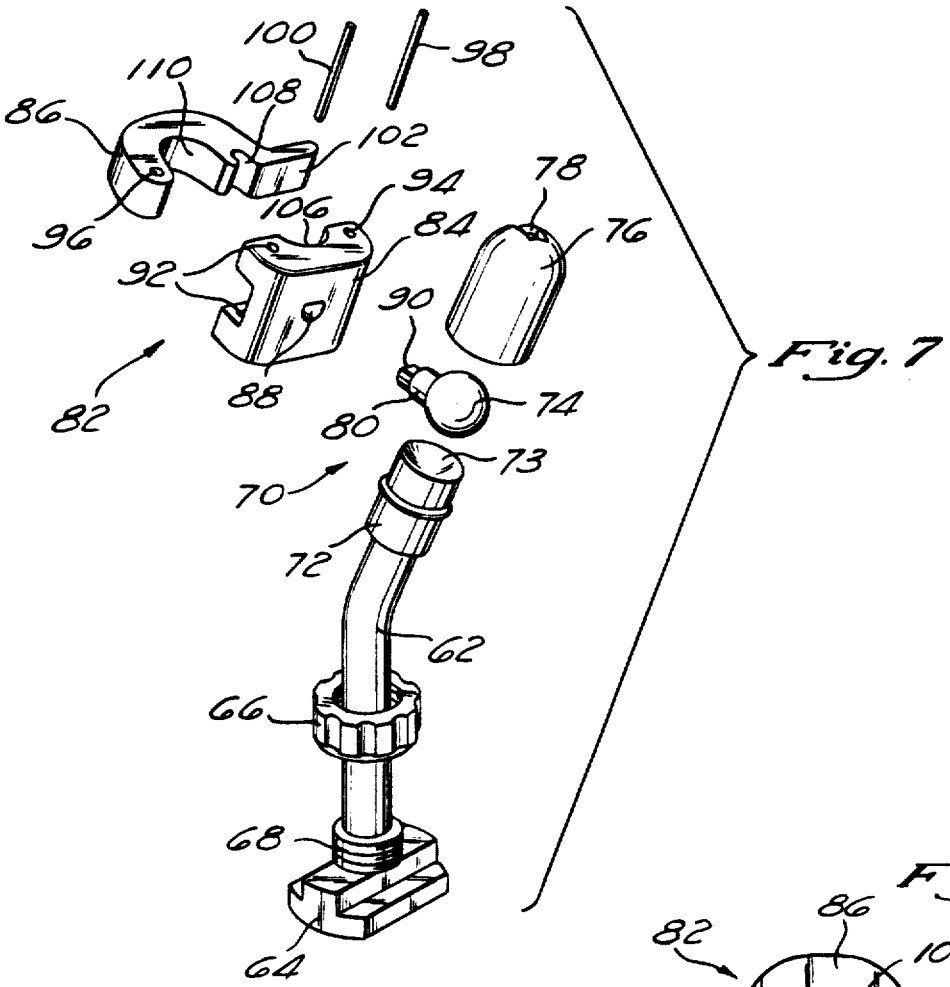
FIG. 7 is an exploded view of the shaft member and mounting means connected thereto.

Extending angularly upwardly from carriage 24 is an elongate shaft member 62. As best seen in FIG. 7, disposed on the lower end of shaft member 62 is a T-shaped coupling 64. T-shaped coupling 64 is adapted to be receivable into T-shaped notch 60 formed within boss 58. In this respect, the receipt of coupling 64 into notch 60 facilitates the attachment of shaft member 62 to carriage 24. Coupling 64 is maintained within notch 60 through the use of an internally threaded knob 66. The receipt of knob 66 onto male threads 68 formed on coupling 64 is operable to maintain coupling 64 within notch 60 in the manner shown in FIG. 4.

Disposed on the upper end of shaft member 62 is a ball and socket joint 70 which is adapted to be angularly adjustable relative to only a horizontal axis. Ball and socket joint 70 generally comprises a socket member 72 which is attached to the upper end of shaft member 62. Socket member 72 defines a generally concave recess 73 which is adapted to receive a ball member 74. As seen in FIG. 4, ball member 74 is maintained within recess 73 by a cap member 76. In this respect, ball member 74 is compressed between socket member 72 and cap member 76. As best seen in FIGS. 4 and 7, disposed within cap member 76 is a slot 78 which is adapted to receive a cylindrical projection 80 extending outwardly from ball member 74. Importantly, when ball and socket joint 70 is assembled, slot 78 is disposed in a generally vertical orientation such that projection 80 may only be pivoted relative to a generally horizontal axis.

Figure 8:
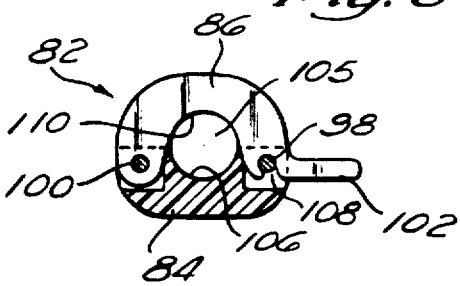
FIG. 8 is a cross-sectional view of the latch mechanism of the mounting means.

Referring now to FIGS. 4–5 and 7–8, attached to ball and socket joint 70 is a latch mechanism 82. Latch mechanism 82 generally comprises a first latch member 84 and second latch member 86. As best seen in FIG. 7, first latch member 84 includes keyway 88 formed therein which is sized and configured to receive a key 90 extending axially outwardly from projection 80 of ball member 74. The receipt of key 90 into keyway 88 facilitates the attachment of latch mechanism 82 to ball and socket joint 70. As can be appreciated, since projection 80 and hence key 90 are only pivotal about a generally horizontal axis, the attachment of latch mechanism 82 to ball and socket joint 70 by way of a keyway 88 likewise makes latch mechanism 82 pivotal about that axis only. Disposed within first latch member 84 are a first pair of apertures 92 and a second pair of apertures 94, each pair being in coaxial alignment. Additionally, disposed within second latch member 86 is an aperture 96. Positioned within coaxially aligned apertures 94 is a first dowel pin 98, the use of which will be discussed in greater detail below. Second latch member 86 is connected to first latch member 84 by orienting second latch member 86 in a manner such that aperture 96 is disposed between and in coaxial alignment with first aperture pair 92. When second latch member is oriented in this manner, a second dowel pin 100 is inserted into first aperture pair 92 as well as aperture 96, thereby interconnecting first latch member 84 to second latch member 86 in the manner shown in FIG. 8. Importantly, latch mechanism 82 is articulable between an open position (not shown) and a closed position as shown in FIG. 8. To move latch mechanism 82 to the open position, a tab 102 formed upon second latch member 86 is grasped by a user and pulled in a direction away from first latch member 84, thereby allowing the shaft of a putter 104 to be positioned within a recess 106 formed within first latch member 84. Because the interconnection between first latch member 84 and second latch member 86 by second dowel pin 100 allows second latch member 86 to be swiveled, second latch member is moved to the closed position by pulling tab 102 toward first latch member 84. In the closed position, second latch member 86 is releasably secured to first latch member 84 through the receipt of the exposed portion of first dowel pin 98 into a notch 108 formed within second latch member 86. When in the closed position, the shaft of the putter 104 is secured in the circular Opening 105 formed by recess 106 formed within first latch member 84 and channel 110 formed within second latch member 86. Importantly, latch mechanism 82 is adapted to receive the shaft portion of putter 104 in a manner wherein the shaft portion of putter 104 may slide axially in a vertical orientation relative to latch mechanism 82 when latch mechanism 82 is in the closed position. Thus, due to this axial movement capability, the user is better able to maintain a normal putting stroke. Additionally, as previously indicated, the use of ball and socket joint 70 allows for the angular adjustment of the putter 104 relative to a horizontal axis (e.g. relative to rod members 12, 14) in the manner shown in FIG. 1 so as to allow the user to hold the putter in a position natural and comfortable to the user.

Figure 10:
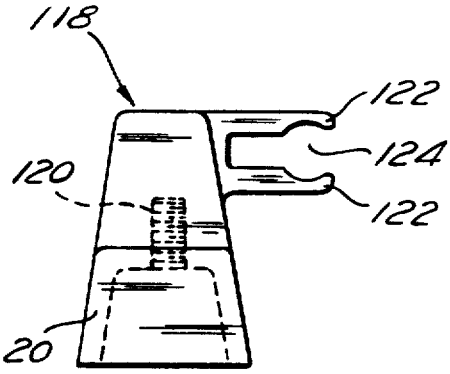
FIG. 10 is a front elevational view of a connector mounted to each of the support legs for maintaining the device in a stowed configuration.
Figure 9:
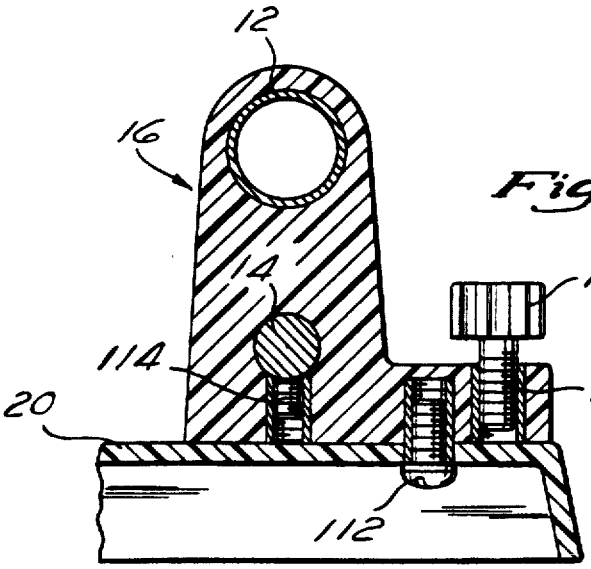
FIG. 9 is a cross-sectional view taken along line 9—9 of FIG. 2.

Referring now to FIG. 9, first end bracket 16 is connected to first support leg 20 by a screw 112. Advantageously, screw 112 is adapted to allow first support leg 20 to swivel relative to first end bracket 16. Lower rod member 14 is secured within first end bracket 16 by a set screw 114 disposed within the lower surface of first end bracket 16. As previously specified, first support leg 20 and second support leg 22 are articulable between an operative position (shown in FIGS. 1-3) and a stowed configuration (not shown). First support leg 20 is maintained within the operative, extended position through the manipulation of a lock knob 116 which is threadably interconnected to first end bracket 16. When lock knob 116 is rotated in a clockwise direction such that the threaded portion 117 thereof is directly abutted against first support leg 20, first support leg 20 is maintained in the extended position. When lock knob 116 is rotated in a counter-clockwise direction such that threaded portion 117 is not in direct contact with first support leg 20 (as shown in FIG. 9), first support leg 20 may be swiveled to the stowed position due to the interconnection of first support leg 20 to first end bracket 16 facilitated by screw 112. First support leg 20 includes a first connector 118 attached thereto adjacent one end thereof which is used to maintain first support leg 20 in the stowed configuration. As seen in FIG. 10, first connector 118 is attached to first support leg 20 by a set screw 120. First connector 118 includes jaws 122 formed thereon which define a generally circular recess 124 therebetween. Importantly, recess 124 is adapted to releasably receive lower rod member 14 so as to maintain first support leg 20 against lower rod member 14 when first support leg 20 is in the stowed position. Though not shown, it will be appreciated that upper rod member 12, lower rod member 14 and second support leg 22 are interfaced to second end bracket 18 in the same manner as previously described with respect to first end bracket 16. Additionally, second end bracket 18 includes a second lock knob 126 which operates in the same manner and is utilized for the same purpose as lock knob 116 as previously described. In this regard, second support leg also includes a second connector 128 attached thereto adjacent one end thereof which also operates in the same manner and for the same purpose as previously described with respect to first connector 118.

Referring now to FIGS. 11 and 12, illustrated is a carriage 200 constructed in accordance with a second embodiment of the present invention. Like carriage 24, carriage 200 is slidably mounted upon upper rod 2 and lower rod 14 in a manner wherein carriage 200 may travel in a horizontal direction between first end bracket 16 and second end bracket 18. Carriage 200 generally comprises an elongate sleeve 202 having a bore 204 extending axially therethrough. In the second embodiment, bore 204 is adapted to receive upper rod member 12 and has a diameter exceeding the diameter of upper rod member 12. Disposed within each end of sleeve 202 are internally threaded apertures 206 and recesses 208. The use of apertures 206 and recesses 208 will be explained in greater detail below.

Attached to one end of sleeve 202 is a first roller housing 210 while attached to the other end of sleeve 202 as a second roller housing 212. First roller housing 210 and second roller housing 212, which are identically configured, each comprise a first housing member 214 and second housing member 216. First housing member 214 defines a first bore 218 extending axially therethrough which is sized and configured to slidably receive upper rod member 12. Importantly, defined within first bore 218 are flats 220 which are adapted to be in sliding contact with the outer surface of upper rod member 12 as carriage 200 moves between first end bracket 16 and second end bracket 18. Disposed within first housing member 214 are a first set of apertures 222 which are positioned in a configuration complementary to the configuration of the apertures 206 disposed within each end of sleeve 202. First housing member 214 further includes cylindrical projections 224 extending outwardly from one side thereof. Extending outwardly from the side of first housing member 214 opposite that from which projections 224 extend, are extensions 226 which have a curved configuration. In the second embodiment, extensions 226 are sized and configured to be slidably receivable into recesses 208 disposed within the opposed ends of sleeve 202. Additionally, extensions 226 are oriented such that when received into recesses 208, the first set of apertures 222 will be in coaxial alignment with the apertures 206 disposed within the opposed ends of sleeve 202. Disposed within the upper portion of the side of first housing member 214 from which projections 224 extend is a first slot 228. First slot 228 is sized and configured to partially receive a roller 230 therewithin in a manner wherein roller 230 is able to rotate within first slot 228.

Second housing member 216 includes a second bore 232 extending axially therethrough which is sized and configured to slidably receive upper rod member 12. Disposed within one side of second housing member 216 are projection receiving apertures 234 and a second slot 236. Projection receiving apertures 234 are positioned in a configuration complementary to the configuration of projections 224 extending outwardly from first housing member 214. In this respect, first housing member 214 is attached to second housing member 216 through the receipt of projections 224 into projection receiving apertures 234. Additionally, second slot 236 is sized and configured to receive the remaining portion of roller 230 not received within first slot 228 of first housing member 214. As such, when first housing member 214 is attached to second housing member 216, roller 230 is free to rotate within the space defined by first slot 228 and second slot 236. Second housing member 216 further includes a second set of apertures 238 disposed therein. When projections 224 are received into projection receiving apertures 234, the second set of apertures 238 are in coaxial alignment with the first set of apertures 224 disposed within first housing member 214. Thus, when extensions 226 of first housing member 214 are received into recesses 208 and projections 224 are received into projection receiving apertures 234, the threaded apertures 206, the first set of apertures 222 and the second set of apertures 238 are all in coaxial alignment. Thus, the receipt of screws such as 240 into the coaxially aligned apertures serves to secure first roller housing 210 and second roller housing 212 to the ends of sleeve 202 as well as maintain the attachment of first housing member 214 to second housing member 216. When upper rod member 12 is inserted into carriage 200, portions of rollers 230 will be in face-to-face contact with the upper rod member 12. Additionally, as previously specified, the upper rod member 12 will also be in sliding contact with the flats 220 included within the first roller housing 210 and second roller housing 212. As can be appreciated, the contact between rollers 230 and upper rod member 12 facilitates the slidable movement of carriage 200 along upper rod member 12.

Extending downwardly from sleeve 202 is a column 242 which defines a generally U-shaped recess 244 therein. U-shaped recess 244 is sized and configured to receive lower rod member 14 in a manner wherein lower rod member 14 may slide therein. Advantageously, the receipt of lower rod member 14 into U-shaped recess 244 is adapted to prevent sleeve 202 from rotating about upper rod member 12. Like carriage 24, sleeve 202 further includes a boss 246 extending upwardly therefrom defining a generally T-shaped notch formed therein which is used for the same purposes as previously described with respect to T-shaped notch 60 of carriage 24.

In utilizing golf putting training device 10, the device 10, which is typically stored within a golf bag, is removed therefrom and first support leg 20 and second support leg 22 are articulated by the user from the stowed position to the extended position. Training device 10 is then placed upon the ground and golf putter 104 attached thereto. Golf putter 104 is attached to training device 10 by pulling tab 102 formed on second latch member 86 in a direction away from first latch member 84 and positioning the shaft of putter 104 into the recess 106 formed within first latch member 84. Tab 102 is then pulled towards first latch member 84 thereby securing putter 104 into the circular opening 105 formed by recess 106 formed within first latch member 84 and channel 110 formed within second latch member 86.

After putter 104 has been secured to training device 10, the user then grasps the handle portion of the putter and positions the putter at an angle which is comfortable and natural to the user. As previously specified, the capacity of putter 104 to be angularly adjusted relative to the upper rod 12 and lower rod 14 is facilitated by ball and socket joint 70. After putter 104 has been properly positioned by the user, the user then moves the putter 104 through a typical putting stroke. Importantly, the putter 104 is maintained in an orientation perpendicular to the intended path of the ball by the movement of carriage 24 or carriage 200 along upper rod 12 and lower rod 14. Additionally, as previously specified, putter 104 may slide axially in a vertical orientation relative to latch mechanism 82 when putter 104 is secured therewithin. As can be appreciated, this axial sliding capacity allows the user to maintain a natural putting stroke, since the putter 104 will necessarily need to change positions within latch mechanism 82 as the user moves the putter 104 through the full back swing and follow-through of the putting stroke. Thus, putting training device 10 allows the user to develop a proper putting stroke which is more natural, comfortable, and automatic. After use of training device 10 is completed, the putter 104 is removed from latch mechanism 82 by manipulating first latch member 84 in the same manner as previously described. First support leg 20 and second support leg 22 are then articulated from the extended position to the stowed position, and the putting training device 10 is then restored within the user's golf bag.

Additional modifications and improvements of the present invention may also be apparent to those skilled in the art. Thus, the particular combination of parts described and illustrated herein is intended to represent only one embodiment of the invention, and is not intended to serve as limitations of alternative devices within the spirit and scope of the invention.

What is claimed is:

1. A golf putting training device comprising:

a pair of end brackets;

a pair of rod members rigidly mounted to and extending between said end brackets, said rod members being in substantial parallel relation in a vertical plane;

a carriage slidably mounted to said rod members in a manner wherein said carriage may travel in a horizontal direction between said end brackets;

an elongate shaft member mounted to and extending upwardly from said carriage; and a mounting means connected to the upper end of said shaft member for releasably mounting a shaft portion of a golf putter to said shaft member in a manner wherein said shaft portion may freely slide axially relative said mounting means as said carriage slides along said rod members during a putting stroke, said mounting means including a ball and socket joint adapted to be articulable about a horizontal axis such that said putter may be angularly adjusted relative said rod members.

2. The device of claim 1 wherein said mounting means includes a latch mechanism movable between an open position and a closed position, said latch mechanism being adapted to receive said shaft portion when in said open position and secure said shaft portion in a manner wherein said shaft portion may slide axially relative said latch mechanism when in said closed position.

3. The device of claim 1 further comprising a pair of support legs attached to said end brackets in a manner wherein said support legs are articulable between an operative position whereat said support legs extend generally perpendicularly relative to said rod members and a stowed position whereat said support legs are disposed in an orientation generally parallel to said rod members.

4. The device of claim 3 wherein each of said support legs include means for releasably attaching said support legs to at least one of said rod members when said support legs are in said stowed position.

* * * * *